US007077094B2

(12) United States Patent
Klotz et al.

(10) Patent No.: US 7,077,094 B2
(45) Date of Patent: Jul. 18, 2006

(54) BALANCE SHAFT GEAR CARRIER DRIVE

(75) Inventors: James R Klotz, Clinton Township, MI (US); James P Savoyard, Fairhaven, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 11/021,154

(22) Filed: Dec. 22, 2004

(65) Prior Publication Data

US 2006/0130797 A1 Jun. 22, 2006

(51) Int. Cl.
*F02B 75/06* (2006.01)

(52) U.S. Cl. ..... 123/192.2

(58) Field of Classification Search ..... 123/192.2
See application file for complete search history.

(56) References Cited

U.S. PATENT DOCUMENTS 3,511,110 A * 5/1970 Grieve ..... 123/192.2
2004/0108167 A1* 6/2004 Elliott ..... 184/6.12

OTHER PUBLICATIONS

"Mancini Racing—Mopar Performance Parts & More!" pp. 1-3, ad from shop.store.yahoo.com, dated Feb. 27, 2004.

* cited by examiner

*Primary Examiner*—Noah P. Kamen
(74) *Attorney, Agent, or Firm*—Thomas A. Jurecko

(57) ABSTRACT

An engine drive assembly includes a camshaft gear, and a first idler gear engaged with the camshaft gear. The engine drive assembly further includes a crankshaft gear engaged with the first idler gear and a second idler gear assembly engaged with the crankshaft gear. Additionally, the engine drive assembly includes a balance shaft gear engaged with the second idler gear. The crankshaft gear drives the camshaft gear via the first idler gear and the crankshaft gear drives the balance shaft gear via the second idler gear assembly.

11 Claims, 8 Drawing Sheets

BALANCE SHAFT GEAR CARRIER DRIVE

TECHNICAL FIELD OF THE INVENTION

This invention relates generally to internal combustion engines, and relates more specifically to driving a camshaft with a crankshaft in a system that includes a balance shaft.

BACKGROUND OF THE INVENTION

Internal combustion engines balance shaking forces resulting from crankshaft and connecting rod assembly rotation. The balance shaft is operable to offset rotational energy created by the rotation of the crankshaft. Both the camshaft and balance shaft are typically driven by gears, or sprockets. A crankshaft gear drives both the camshaft gear and the balance shaft gear, often using belts or chains. Unfortunately, belts or chains may break and often require tensioners. Tensioners add to the complexity, and cost, of building or repairing engines. In addition, tensioners may be remotely located and tensioner placement can result in parasitic energy losses.

Each gear rotates at a speed inversely proportional to its relative radius compared to the crankshaft gear. For example, if camshaft gear radius is twice the radius of the crankshaft gear, the camshaft will rotate at half the speed of the crankshaft gear. Similarly, balance shaft gear rotates at twice the speed of the crankshaft gear, if the radius of the balance shaft gear is half the radius of the crankshaft gear.

SUMMARY OF THE INVENTION

One aspect of the invention provides an engine drive assembly including a camshaft gear engaged with a first idler gear. The first idler gear is engaged with a crankshaft gear. The crankshaft gear is engaged with a second idler gear assembly. The second idler gear assembly is engaged with a balance shaft gear. The crankshaft gear drives the camshaft gear via the first idler gear and the crankshaft gear drives the balance shaft gear via the second idler gear assembly.

Another aspect of the invention provides an auxiliary shaft (such as a balance shaft) gear carrier drive including an auxiliary shaft housing and a camshaft gear supported by the balance shaft housing. The auxiliary shaft gear carrier drive further includes a first idler gear engaged with the camshaft gear and a crankshaft gear engaged with the first idler gear, the crankshaft gear supported by the auxiliary shaft housing. The second idler gear assembly is engaged with the crankshaft gear. The balance shaft gear carrier drive further includes a auxiliary shaft gear engaged with the second idler gear, the auxiliary shaft gear supported by the auxiliary shaft housing. The crankshaft gear drives the camshaft gear via the first idler gear and the crankshaft gear drives the auxiliary shaft gear via the second idler gear assembly.

Yet another aspect of the invention provides an auxiliary shaft gear carrier system. The system includes means for rotating a camshaft in a camshaft direction using idler gear means; and means to rotate a auxiliary shaft in a direction opposite the camshaft direction using idler gear means. The means for rotating the camshaft and auxiliary shaft includes a crankshaft.

These and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
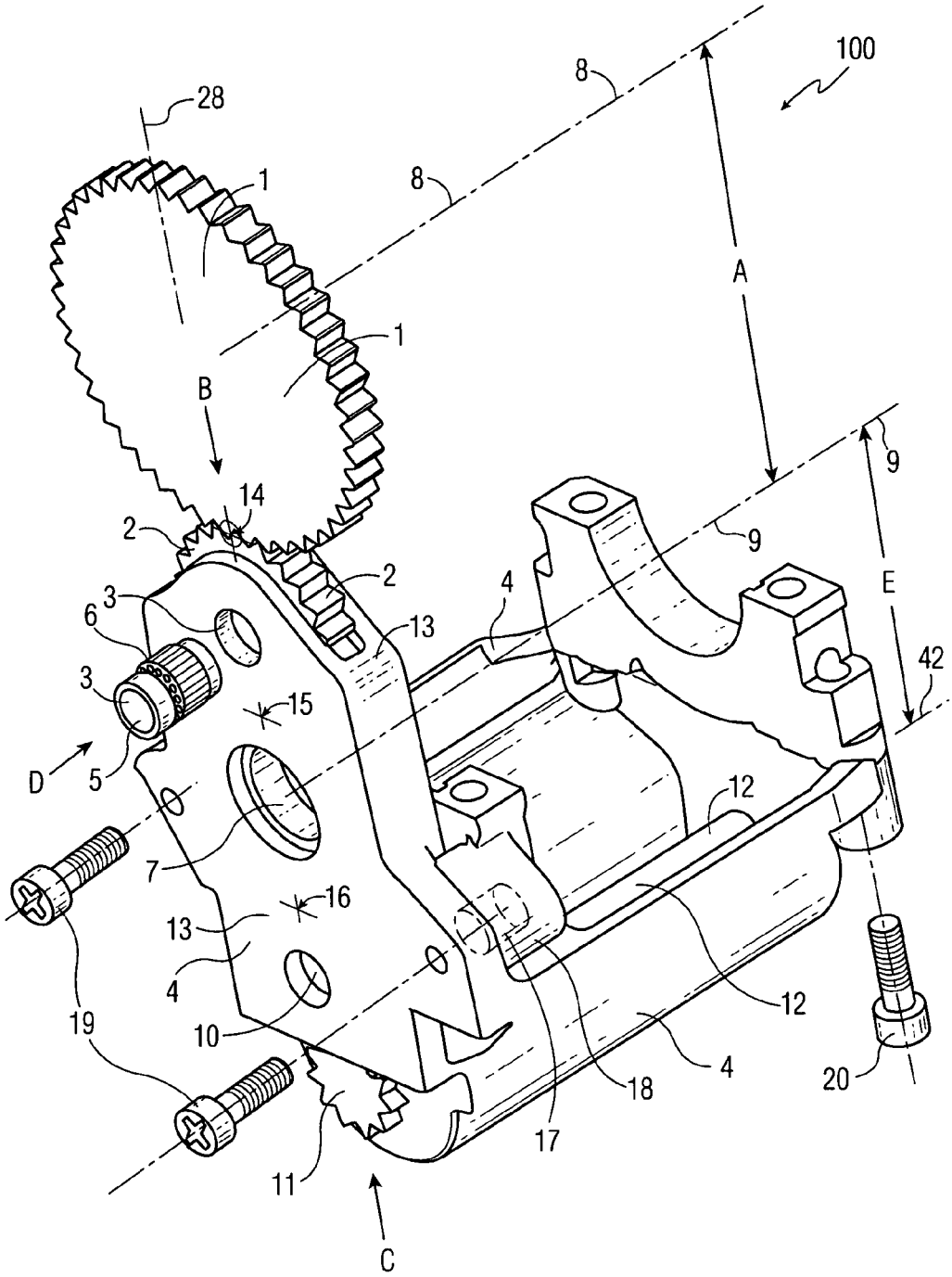
FIG. 1 is a perspective view of a gear train and balance shaft housing according to the present invention.
Figure 2:
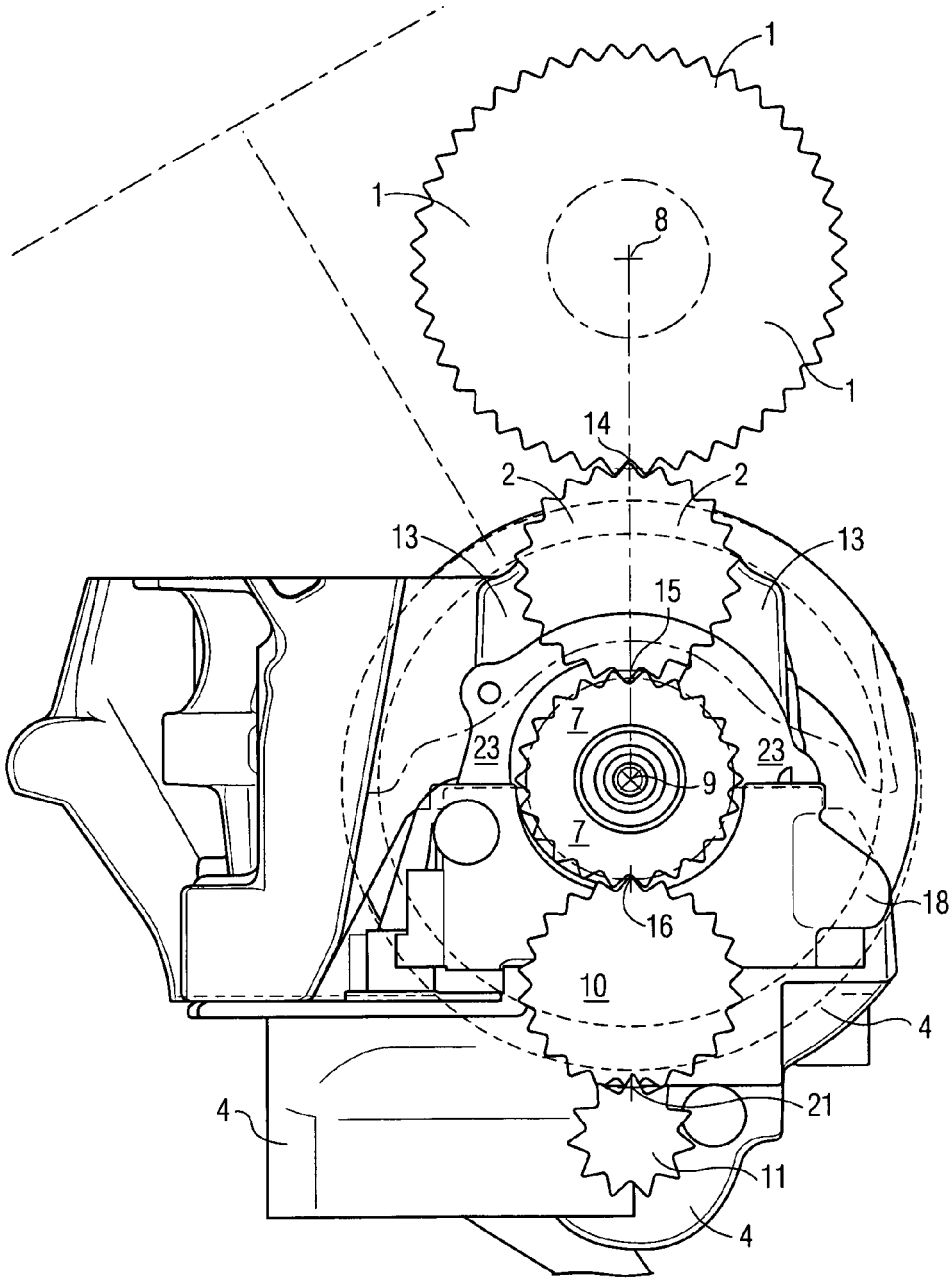
FIG. 2 is a front view of the gear train and balance shaft housing according to the present invention.

FIG. 1 shows one embodiment of an engine drive assembly 100 according to the present invention. The engine drive assembly 100 includes balance shaft housing 4 supporting camshaft gear 1, crankshaft gear 7, and balance shaft gear 11. Crankshaft gear 7 rotates about a crankshaft gear centerline 9. Crankshaft 26 (FIG. 4) drives crankshaft gear 7. Camshaft gear 1 rotates about camshaft centerline 8 and is operable to rotate camshaft 25 (FIG. 4) in a camshaft direction. Balance shaft gear 11 rotates about balance shaft gear centerline 42 and is operable to rotate balance shaft 12 (which also forms an auxiliary shaft in accordance with the present invention) in a balance shaft direction opposite to the camshaft direction. For example, if camshaft 25 rotates clockwise, balance shaft 12 rotates counter-clockwise.

Engine drive assembly 100 includes axial shaft 3 pressed and roll formed into balance shaft housing 4. Axial shaft 3 supports first idler gear 2. Axial shaft 5 supports needle bearing compliment 6. First idler gear 2 is engaged with crankshaft gear 7. In one embodiment, first idler gear 2 is in direct physical engagement with crankshaft gear 7, such that the gear teeth of first idler gear 2 intermesh with the gear teeth of crankshaft gear 7. Distance A, between crankshaft gear centerline 9 and camshaft gear centerline 8 accommodates first idler gear 2. In one embodiment, the radius of first idler gear 2 is substantially the same as the radius of crankshaft gear 7. In one embodiment, the radius of first idler gear 2 is substantially one half the radius of camshaft gear 1.

In the embodiment, illustrated in FIGS. 1–4, engine drive assembly 100 further includes second idler gear 10. Second idler gear 10 is engaged with crankshaft gear 7. In one embodiment, second idler gear 10 is in direct physical engagement with crankshaft gear 7, such that the gear teeth of second idler gear 10 intermesh with the gear teeth of crankshaft gear 7. Distance E, between crankshaft gear centerline 9 and balance shaft gear centerline 42 accommodates second idler gear 10. In one embodiment, the radius of second idler gear 10 is substantially the same as the radius of crankshaft gear 7. In one embodiment, the radius of second idler gear 10 is substantially twice the radius of balance shaft gear 11.

First and second idler gears 2, 10 are loaded into carrier segment 13 of balance shaft housing 4 in direction of arrow B and arrow C, respectively. Axial shaft 5 is loaded into carrier segment 13 in direction of arrow D to retain first and second idler gears 2, 10. Balance shaft housing 4 is mounted to an engine (not shown) in direction of arrow D.

Crankshaft gear 7 engages first idler gear 2 at 15 driving camshaft gear 1 at 14. Crankshaft gear 7 engages second idler gear 10 at 16 driving balance shaft gear 11 at 21. Balance shaft housing 4 is piloted on dowels 17 pressed into modified bearing cap 18. Fasteners 19 and 20 mount balance shaft housing 4 to the engine.

Balance shaft housing 4 includes balance shaft housing centerline 28. In one embodiment, camshaft gear centerline 8 intersects balance shaft housing centerline 28. In one embodiment, crankshaft gear centerline 9 intersects balance shaft housing centerline 28. In one embodiment, balance shaft gear centerline 42 intersects balance shaft housing centerline 28. In one embodiment, balance shaft housing centerline 28 is co-linear with the radius of first and second idler gears 2, 10 such that the center of first and second idler gears 2, 10 is disposed upon balance shaft housing centerline 28. In the embodiment illustrated in FIGS. 5–8, only the radius of first idler gear 52 is co-linear upon balance shaft housing centerline 28.

Figure 3:
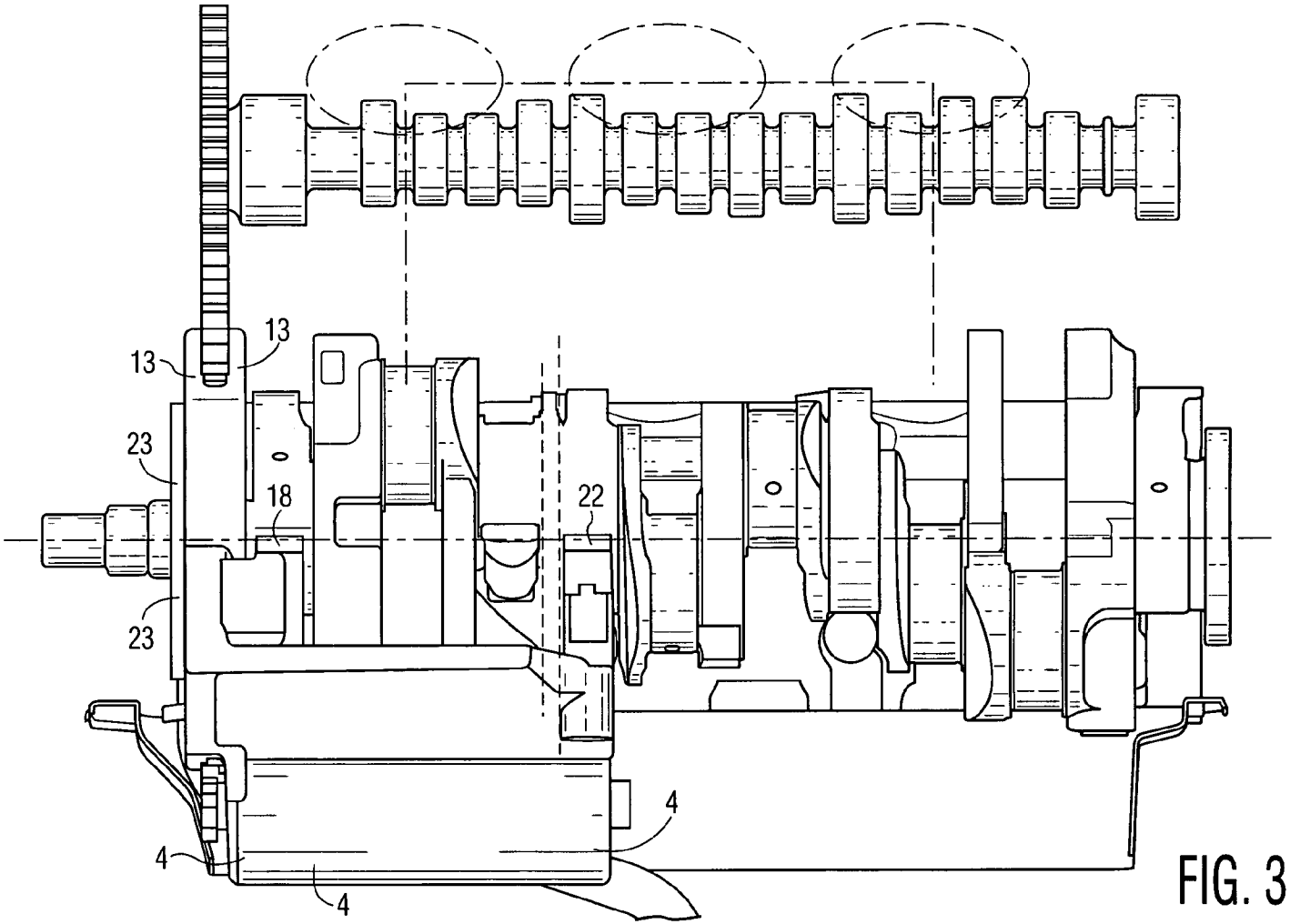
FIG. 3 is a side view of the gear train and balance shaft housing according to the present invention.
Figure 4:
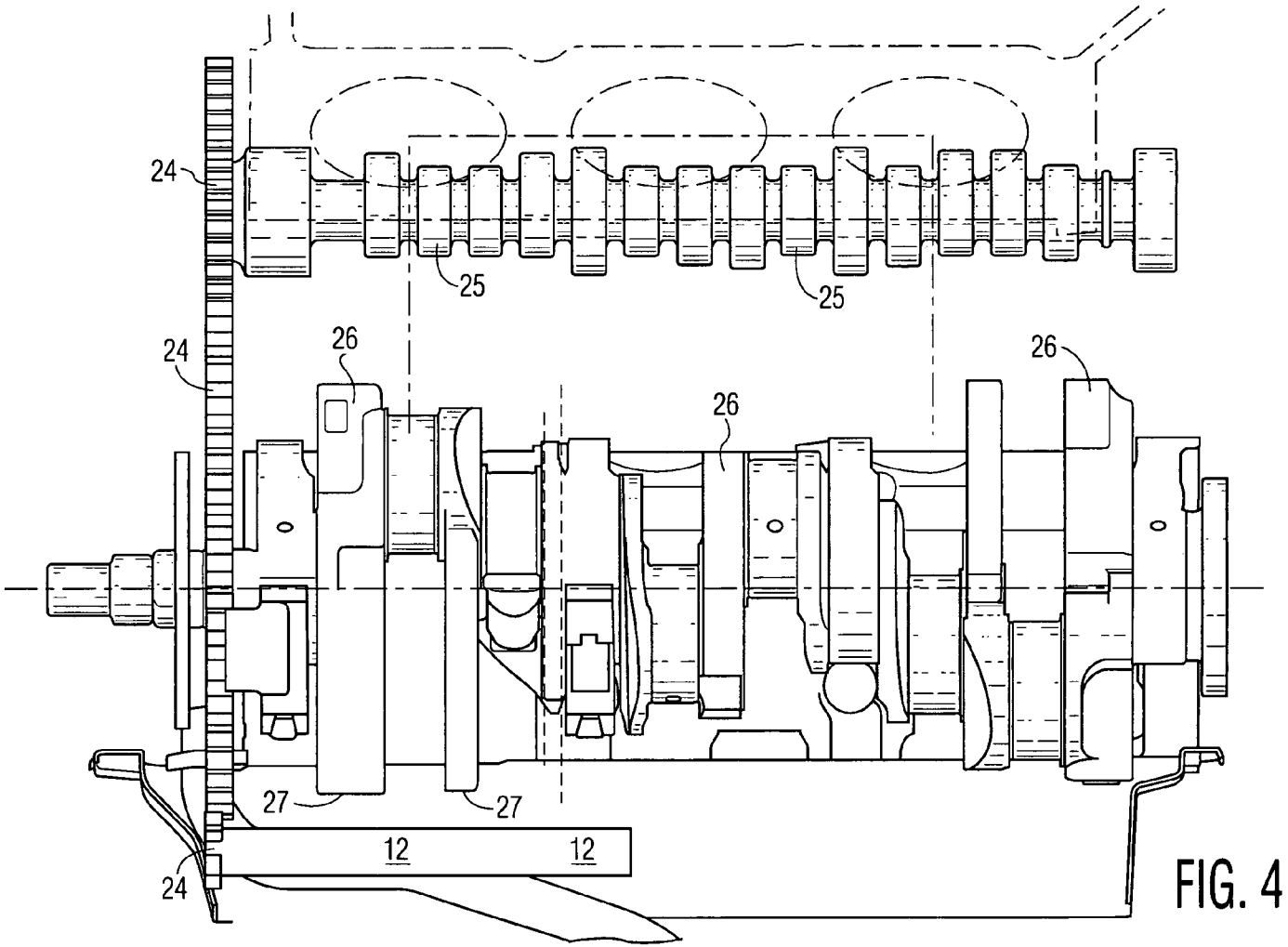
FIG. 4 is a side view of the gear train and balance shaft housing according to the present invention.
Figure 5:
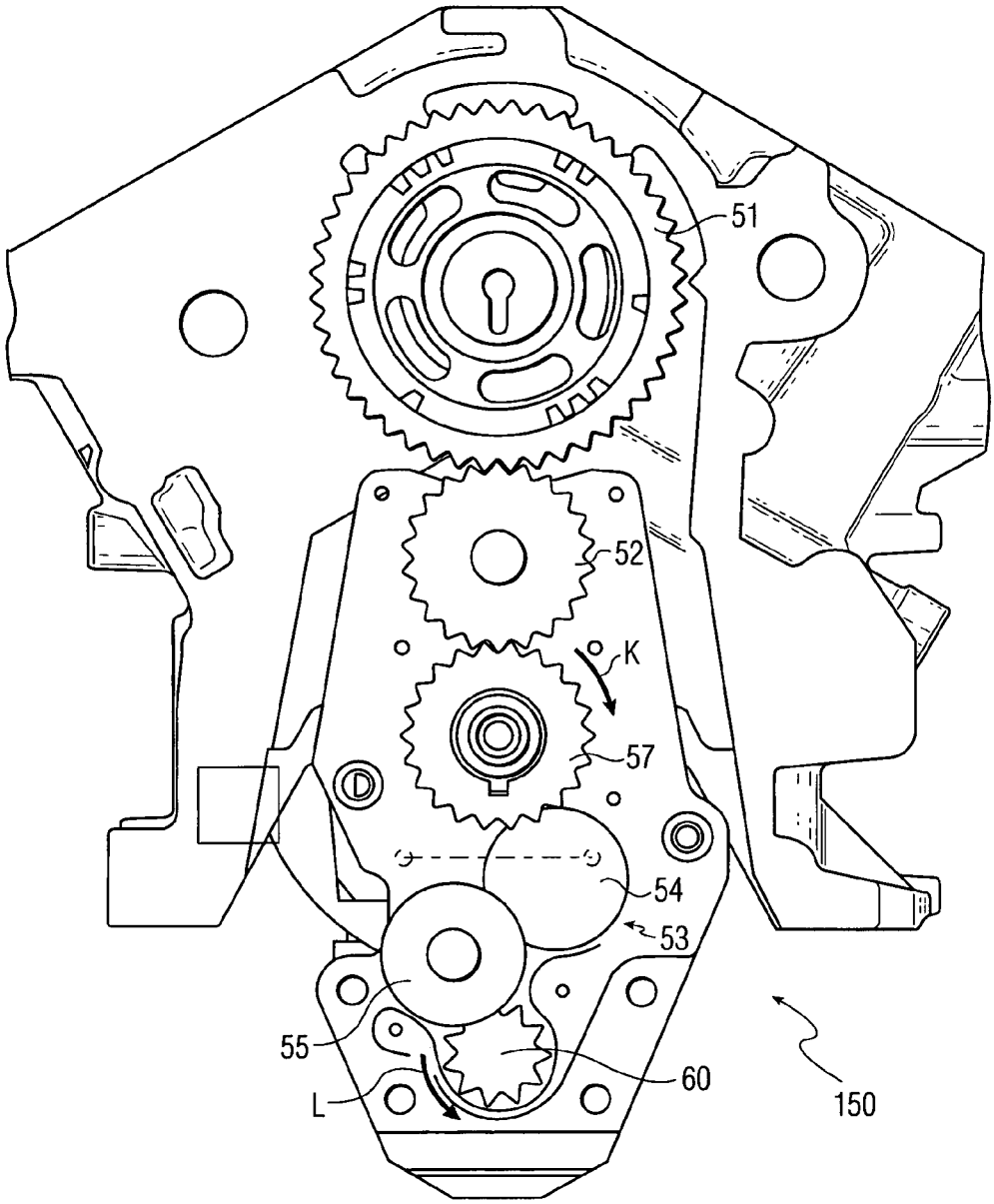
FIG. 5 is a front view of another embodiment of a gear train and balance shaft housing according to the present invention.

FIG. 3 illustrates balance shaft housing 4 mounted to bearing caps 18 and 22 behind oil pump cover plate 23. FIG. 4 further illustrates crankshaft counterweights 27. Those of ordinary skill in the art will readily recognize that dynamic masses are not illustrated on balance shaft 12, but dynamic masses may be used in accordance with the invention.

As shown in FIGS. 1–4, camshaft gear 1 rotates one half speed of the first idler gear 2. As further shown in FIGS. 1–4, second idler gear 10 includes a single gear. Those of ordinary skill in the art will readily recognize that the second idler gear 10 will require additional means to rotate the balance shaft gear in the opposite direction as the camshaft direction. It should also be noted that the means to rotate the balance shaft gear in the opposite direction include, in one embodiment, providing an even number of first idler gears between the camshaft gear and the crankshaft gear.

The size and pitch of first idler gear 2 and second idler gear is a design and manufacturing choice. The size and pitch of first and second idler gear 2, 10 are further constrained by the distance between camshaft gear 1 and crankshaft gear 7 and the distance between crankshaft gear 7 and balance shaft gear 11.

FIGS. 5–8 illustrate another embodiment of an engine drive assembly 150 in accordance with the present invention. Engine drive assembly 150 includes camshaft gear 51, crankshaft gear 57, and balance shaft gear 60. Engine drive assembly 150 further includes first idler gear 52 and second idler gear assembly 53. Second idler gear assembly 53 includes crankshaft idler gear 54 and balance shaft idler gear 55. Crankshaft gear 57 rotates in the direction indicated by arrow K. Second idler gear assembly 53 engages with crankshaft gear 57 and balance shaft gear 60 to rotate balance shaft gear 60 in the direction indicated by arrow L.

As in the embodiment illustrated in FIGS. 1–4, the gear teeth of first idler gear 52 engage with the gear teeth of camshaft gear 51 and crankshaft gear 57 such that the gear teeth intermesh and enable crankshaft gear 57 to drive camshaft gear 51 via first idler gear 52. Similarly, the gear teeth of crankshaft gear 57 engage with the gear teeth of crankshaft idler gear 54 and the gear teeth of crankshaft idler gear 54 engage with balance shaft idler gear 55. The gear teeth of balance shaft idler gear 55 engage the gear teeth of balance shaft 60 such that crankshaft gear 57 drives balance shaft 60 via second idler gear assembly 53.

Figure 6:
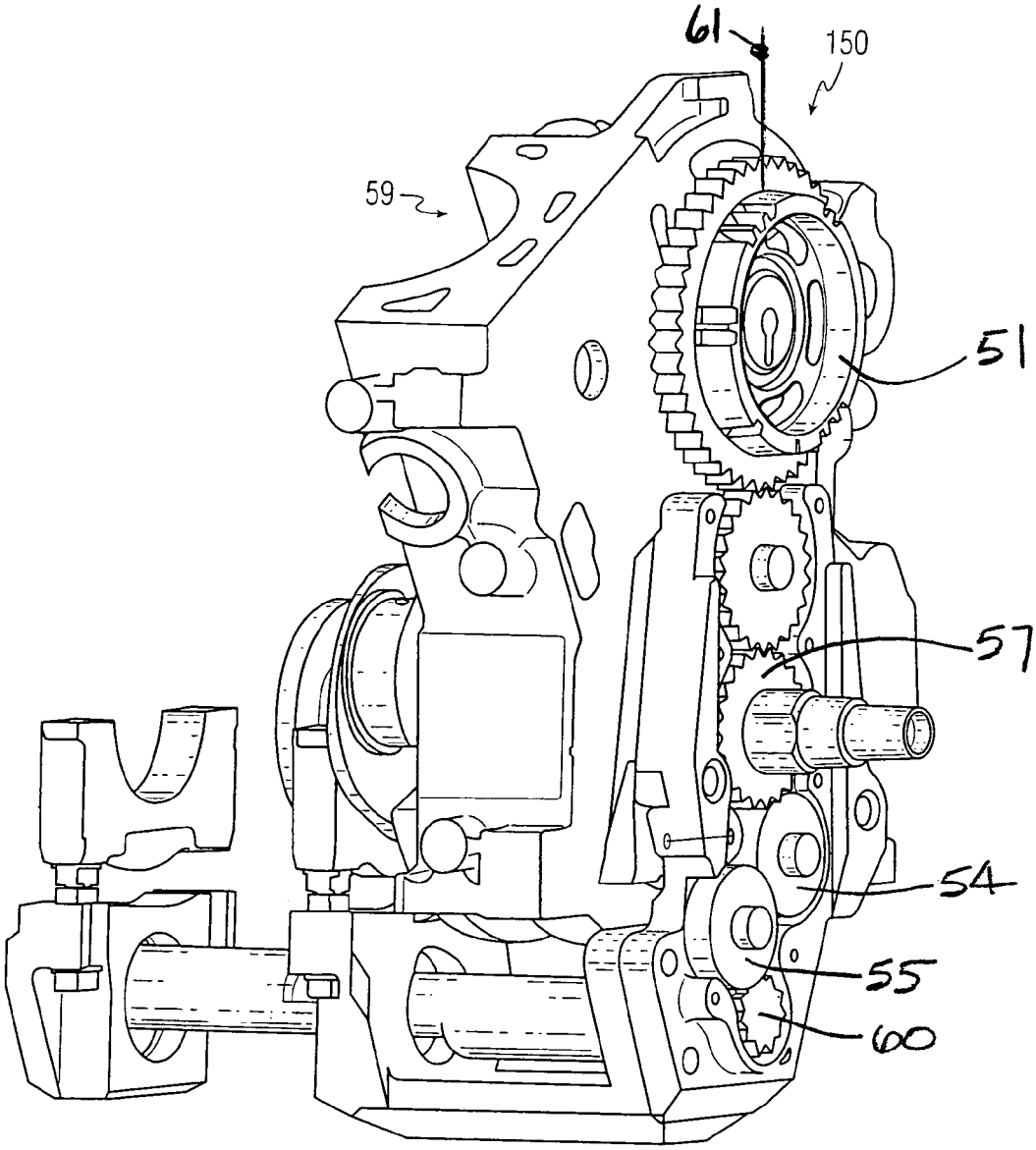
FIG. 6 is a perspective view of another embodiment of a gear train and balance shaft housing according to the present invention.

FIG. 6 is a perspective view of the engine drive assembly 150. Block 59 is shown. Furthermore, FIG. 6 illustrates that the centerlines of camshaft gear 51, crankshaft gear 57 and balance shaft 60 are parallel to each other and disposed along a block centerline 61. As illustrated in FIG. 6, the centerlines of crankshaft idler gear 54 and balance shaft idler gear 55 lie parallel to the centerline of camshaft gear 51. However, the centerlines of crankshaft idler gear 54 and balance shaft idler gear 55 could be disposed along block centerline 61 if the radiuses of crankshaft idler gear 54 and balance shaft idler gear 55 were set such that second idler gear assembly 53 could fit between crankshaft gear 57 and balance shaft gear 60.

Figure 7:
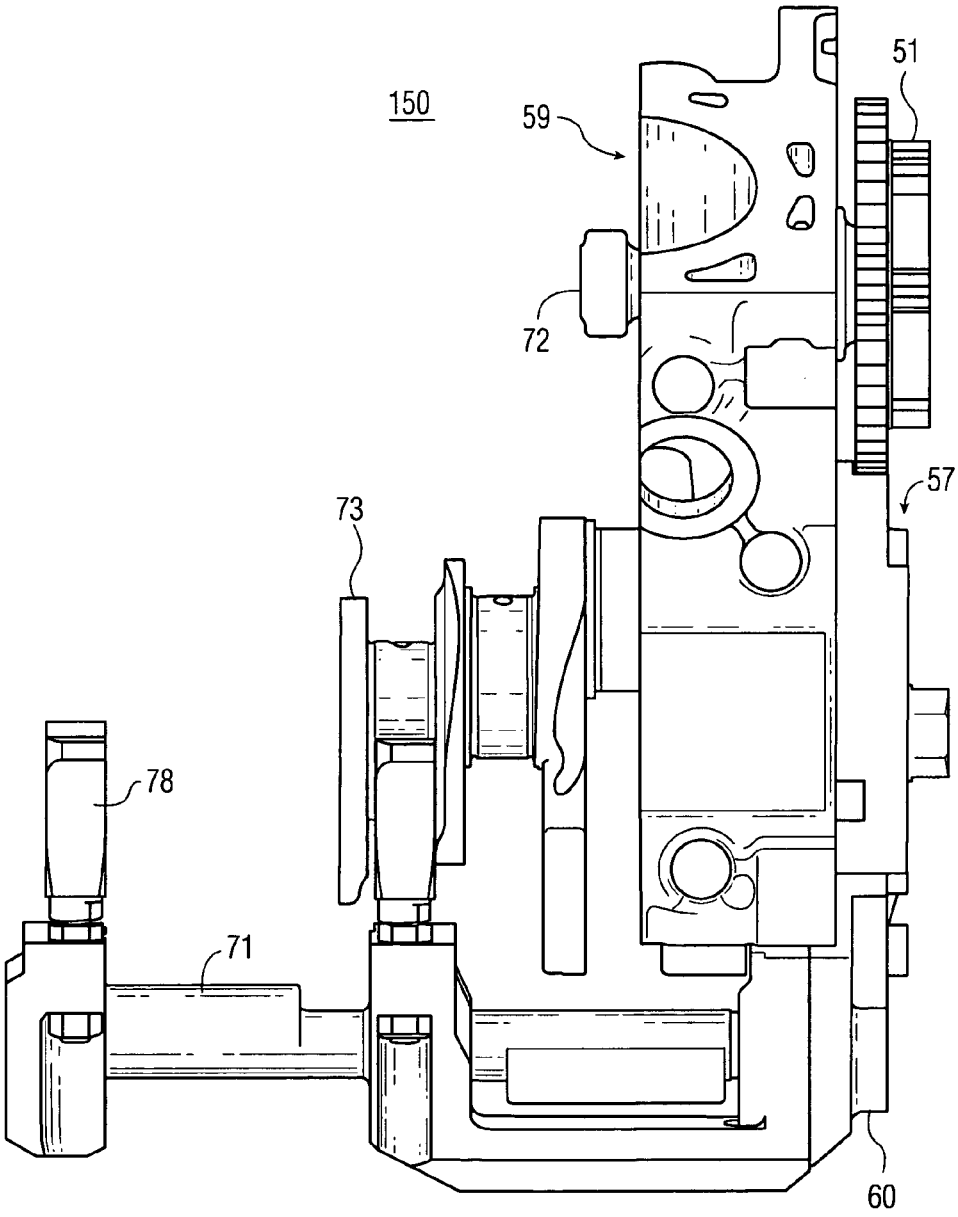
FIG. 7 is a side view of another embodiment of a gear train and balance shaft housing according to the present invention.

FIG. 7 is a side view of the engine drive assembly 150. Balance shaft 71 is shown connected to balance shaft gear 60. Similarly, camshaft 72 is shown extending through block 59 and connected to camshaft gear 51. Crankshaft 73 extends through block 59 and connects to crankshaft gear 57. Bearing cap 78 supports balance shaft 71.

Figure 8:
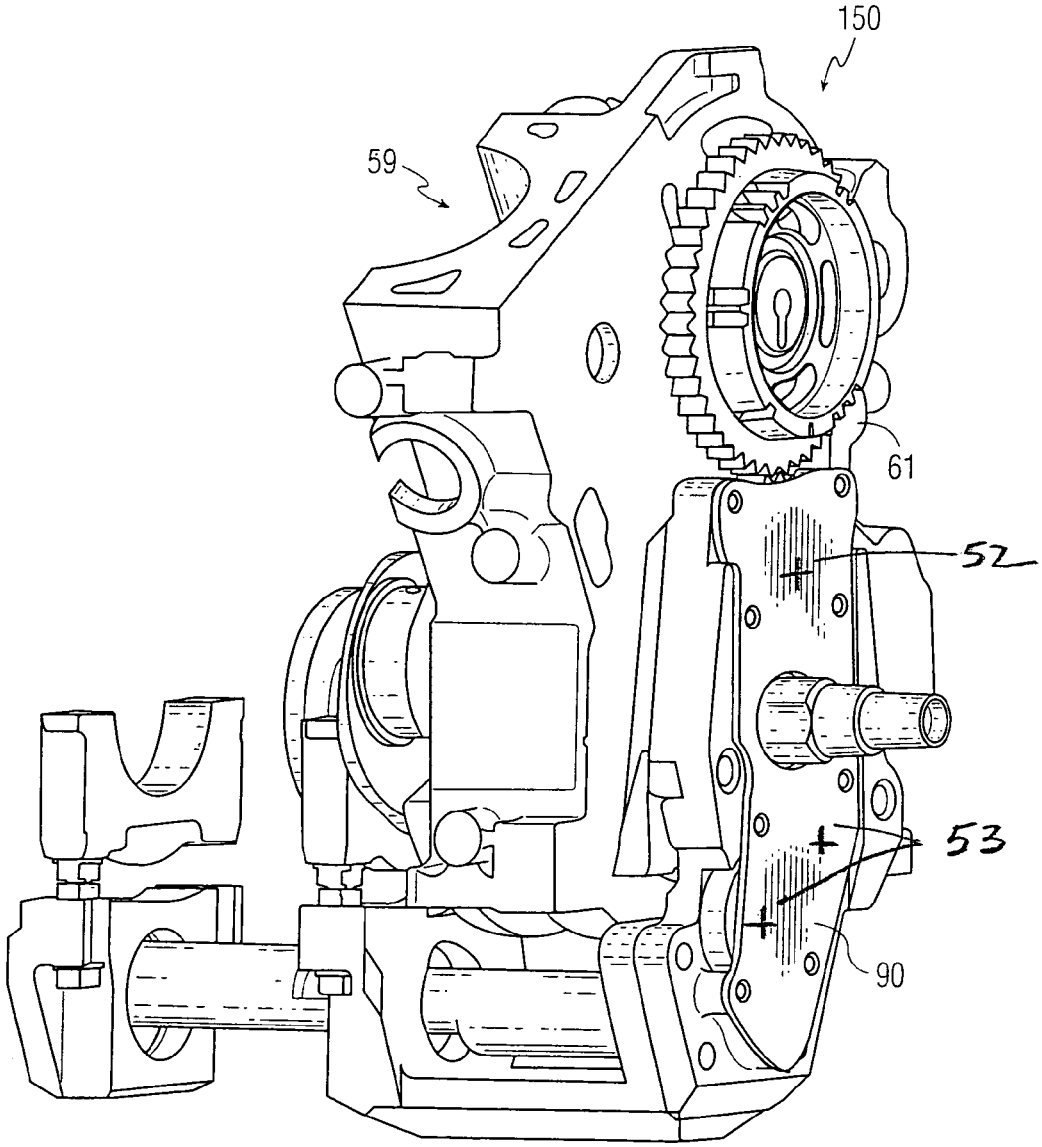
FIG. 8 is a perspective view of another embodiment of a gear train and balance shaft housing according to the present invention.

FIG. 8 illustrates cover 90 over engine drive assembly 150. In one embodiment cover 90 assists in maintaining the position of second idler gear assembly 53 and first idler gear 52. Similar covers may be used to maintain position of the first and second idler gears 2, 10 depicted in FIGS. 1–4. In one embodiment, the cover is implemented as a carrier segment of a balance shaft housing.

The embodiments of the invention illustrated in FIGS. 1–8 may also be implemented as a balance shaft gear carrier drive. In such embodiments, the balance shaft gear carrier drive includes a balance shaft housing and a camshaft gear supported by the balance shaft housing. The camshaft gear is engaged with a first idler gear that is further engaged with a crankshaft gear that is supported by the balance shaft housing. The crankshaft gear is further engaged with a second idler gear assembly that is engaged with a balance shaft gear. The balance shaft gear is supported by the balance shaft housing. As in FIGS. 1–8, the crankshaft gear drives the camshaft gear via the first idler gear and the crankshaft gear drives the balance shaft gear via the second idler gear assembly.

The size and pitch of first idler gear 52, crankshaft idler gear 54 and balance shaft idler gear 55 is a design and manufacturing choice. The size and pitch of first idler gear 52, crankshaft idler gear 54 and balance shaft idler gear 55 are further constrained by the distance between camshaft gear 51 and crankshaft gear 57 and the distance between crankshaft gear 57 and balance shaft gear 60.

Use of a first and second idler gear assembly as described herein, in one embodiment, reduces parasitic energy loss within a balance shaft system by providing a compact system. As used herein, the term "gear" includes rotors or hubs connected to a shaft to rotate the shaft in a desired direction.

The disclosure herein encompasses a design wherein an idler gear assembly is included between the crankshaft gear and camshaft gear and a single gear is included between the crankshaft gear and balance shaft gear. While the embodiment of the invention disclosed herein is presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. An engine drive assembly comprising:

a camshaft gear;

a first idler gear engaged with the camshaft gear;

a crankshaft gear engaged with the first idler gear;

a second idler gear assembly engaged with the crankshaft gear; and a balance shaft gear engaged with the second idler gear;

wherein the crankshaft gear drives the camshaft gear via the first idler gear and the crankshaft gear drives the balance shaft gear via the second idler gear assembly, wherein the camshaft gear, first idler gear, crankshaft rear, second idler gear assembly, and balance shaft gear are supported with a balance shaft housing, the balance shaft housing including a balance shaft housing centerline, and wherein the camshaft gear, first idler gear, crankshaft gear, and balance shaft gear are each disposed along the balance shaft housing centerline.

2. The assembly of claim 1 wherein the second idler gear assembly comprises a plurality of gears.

3. The assembly of claim 1 wherein the second idler gear assembly comprises a crankshaft idler gear that rotates about a crankshaft idler gear centerline and a balance shaft idler gear that rotates about a balance shaft idler gear centerline, and wherein the balance shaft idler gear does is not disposed along the balance shaft housing centerline.

4. The assembly of claim 1 wherein the second idler gear assembly includes a second idler gear assembly centerline, the second idler gear assembly centerline disposed along the balance shaft housing centerline and parallel with the crankshaft centerline.

5. The assembly of claim 1 wherein the first idler gear rotates about a first idler gear centerline and wherein the first idler gear centerline is parallel to the crankshaft centerline.

6. A balance shaft gear carrier drive, including:

a balance shaft housing;

a camshaft gear supported by the balance shaft housing;

a first idler gear engaged with the camshaft gear;

a crankshaft gear engaged with the first idler gear, the crankshaft gear supported by the balance shaft housing;

a balance shaft gear; and a second idler gear assembly, the second idler gear assembly including a crankshaft idler gear engaged with a balance shaft idler gear, the crankshaft idler gear engaged with the crankshaft gear and the balance shaft idler rear engaged with the balance shaft gear;

wherein the crankshaft gear drives the camshaft gear via the first idler gear and the crankshaft gear drives the balance shaft gear via the second idler gear assembly; and wherein the crankshaft idler gear includes a crankshaft idler gear centerline and the balance shaft idler gear includes a balance shaft idler gear centerline, the crankshaft idler gear centerline and balance shaft idler gear centerline disposed along a block centerline.

7. The balance shaft gear carrier drive of claim 6 wherein the first idler gear is in direct contact with the camshaft gear and crankshaft gear, and wherein the second idler gear assembly is in direct contact with the balance shaft gear and crankshaft gear.

8. The balance shaft gear carrier of claim 6, further including a cover.

9. A balance shaft gear carrier drive, including:

a balance shaft housing;

a camshaft gear supported by the balance shaft housing;

a first idler gear engaged with the camshaft gear;

a crankshaft gear engaged with the first idler gear, the crankshaft gear supported by the balance shaft housing;

a balance shaft gear; and a second idler pear assembly the second idler gear assembly including a crankshaft idler gear engaged with a balance shaft idler gear, the crankshaft idler gear engaged with the crankshaft gear and the balance shaft idler gear engaged with the balance shaft gear;

wherein the crankshaft gear drives the camshaft gear via the first idler gear and the crankshaft gear drives the balance shaft gear via the second idler gear assembly; and wherein the crankshaft idler gear includes a crankshaft idler gear centerline and the balance shaft idler gear includes a balance shaft idler gear centerline, the crankshaft idler gear centerline and balance shaft idler gear centerline not disposed along a block centerline.

10. The balance shaft gear carrier of claim 9, further including a cover.

11. The balance shaft gear carrier drive of claim 9 wherein the first idler gear is in direct contact with the camshaft gear and crankshaft gear, and wherein the second idler gear assembly is in direct contact with the balance shaft gear and crankshaft gear.

* * * * *